US006041637A

United States Patent [19]

Tashiro et al.

[11] Patent Number: 6,041,637

[45] Date of Patent: Mar. 28, 2000

[54] ROLL REPLACING METHOD AND SYSTEM FOR CHOCKLESS ROLLING MILL

[75] Inventors: Shoozoo Tashiro; Akira Sako; Toru Takeguchi, all of Hiroshima, Japan

[73] Assignee: Mitsubishi Heavy Industries, Ltd., Tokyo, Japan

[21] Appl. No.: 09/177,104

[22] Filed: Oct. 22, 1998

[30] Foreign Application Priority Data

Oct. 22, 1997 [JP] Japan ..... 9-289473

[51] Int. Cl.[7] ..... B21B 31/08

[52] U.S. Cl. ..... 72/239

[58] Field of Search ..... 72/237, 238, 239

[56] References Cited

U.S. PATENT DOCUMENTS

| | | | |
|---|---|---|---|
| 3,376,724 | 4/1968 | Wolfendale et al. | 72/239 |
| 3,782,161 | 1/1974 | McGeeney et al. | 72/239 |
| 4,653,304 | 3/1987 | Feldmann et al. | 72/239 |
| 5,050,418 | 9/1991 | Grotepass | 72/239 |

FOREIGN PATENT DOCUMENTS 8229605 9/1996 Japan .

*Primary Examiner*—Joseph J. Hail, III
*Assistant Examiner*—Rodney Butler

[57] ABSTRACT

A roll replacing method and a roll replacing system for a chockless rolling mill, in which bearings for supporting the ends of work rolls are supported at an eccentric position of rotary bushes on housings, and the rotary bushes are turned to set a roll gap, includes, pulling out the chockless rolling mill from a rolling line onto a pullout track extending perpendicularly to the rolling line; fixing the housing on a drive side onto the pullout track at a nearest position, moving a support trestle perpendicularly to the pullout track, and fitting the support trestle between the pullout track and the upper and lower work rolls to support these work rolls on the support trestle; separating the housing on a work side, the trestle, and the upper and lower work rolls, as a unit, from each other and from the drive-side housing, and moving them onto the pullout track until they come to a halt; and moving the trestle and the upper and lower work rolls as a unit onto a roll replacement track perpendicular to the pullout track, to replace the upper and lower work rolls as a unit by spare upper and lower work rolls as a unit, or to replace the trestle and the upper and lower work rolls, as a unit, by a spare trestle and spare upper and lower work rolls as a unit.

2 Claims, 10 Drawing Sheets

2、2' : Drive—Side Housing
2、2" : Work—Side Housing
8、9 : Upper and Lower Work Rolls
20 : Hot Rolling Line
21 : Chockless Rolling Mill
22 : Motor for Work Roll 2、2' : Drive—Side Housing
2、2" : Work—Side Housing
8、9 : Upper and Lower Work Rolls
20 : Hot Rolling Line
21 : Chockless Rolling Mill
22 : Motor for Work Roll 23 : Speed Reducer
24 : Rolling Mill Pullout Track
25 : Detachable Beam
26 : Drive—Side Housing Fixing Means
27 : Roll Support Trestle
28 : Trestle Yard
29 : Roll Replacement Track
30 : Work—Side Housing Fixing Means
31 : Pullout Drive Means
32 : Roll Replacement Drive Means 33 : Trestle
34 : Vertical Projection
35 : Slide Block Mechanism
36 : Press Anchor Mechanism 38 : Fixed Track
38a : Connecting Track
39 : Trolley Track
40 : Moving Trolley
41 : Track on Trolley
42 : Moving Base
43 : Horizontal Support Member
44 : Horizontal Grooved Track
44' : Horizontal Grooved Track on Trolley
45 : Horizontal Projection on Roll Support Trestle 27 : Roll Support Trestle
48 : Roll Trestle Frame
49 : Roll Support Beam
50a、50b : Liner
51 : Roll Support Surface
52 : Beam Push-up Jack
53 : Detachable Drive Means

ROLL REPLACING METHOD AND SYSTEM FOR CHOCKLESS ROLLING MILL

BACKGROUND OF THE INVENTION

1. Field of the Invention

The present invention relates to a roll replacing method and a roll replacing system for a chockless rolling mill which rolls a band plate such as a steel plate.

2. Description of the Related Art

Among rolling mills for hot rolling a band plate such as a steel plate, there is a rolling mill of the type shown in Japanese Unexamined Patent Publication No. 229605/96. FIGS. 10 to 11 show this type of rolling mill. An outline of this type of rolling mill will be described by reference to FIGS. 10 to 11.

In FIGS. 10 to 11, a pair of housings 2 for supporting work rolls are placed facing each other on a pair of base blocks 1. On each housing 2, two bushes 3 for eccentrically supporting the work rolls are rotatably provided via bearing metals so as to be in agreement with two axes arranged vertically parallel along the direction in which the housings are opposed to each other. The rotary bush 3 has one end protruding outward of the housing 2. On the protruding outer periphery of the rotary bush 3, a worm wheel 4 is provided. $O_1$ is a center of rotation of the rotary bush 3.

On the outer wall surfaces of the housings 2 near the worm wheels 4, drive motors 5 are provided. On a drive shaft 5*a* of each drive motor 5, a worm 6, meshing with the worm wheel 4, is provided.

On each rotary bush 3, a bearing 7 for supporting the work roll, which has a center of rotation $O_2$, is provided at an eccentric position spaced by a tiny distance from the center of rotation $O_1$ of the rotary bush 3. Shaft portions 8*a* and 9*a* at both ends of the pair of upper work roll 8 and lower work roll 9, are supported by the bearings 7.

When the drive motor 5 is actuated, the upper work roll 8 is turned upwardly eccentrically, and the lower work roll 9 is turned downwardly eccentrically, at a suitable angle of rotation. Thus, an arbitrary roll gap G is established between the upper and lower work rolls 8 and 9, so that a band plate 10 is passed through the roll gap G, and rolled thereby.

The above-described type of rolling mill has a structure without a bearing box which can be removed together with rolls, i.e., a roll chock, as in earlier technologies. This type of rolling mill will be called a chockless rolling mill hereinbelow.

Generally, the work rolls of rolling mill have a roll surfaces roughened and worn by a rolling operation. When the rolls are surface-roughened, the rolling line is stopped, and the surface-roughened rolls are replaced by polished spare rolls (or fresh rolls). Then, the rolling operation is performed again, by the fresh rolls, while the removed rolls are being polished. This procedure is repeated. The rolls are replaced several times everyday.

With the aforementioned chockless rolling mill, when the housing 2 is fixed to the line, the work rolls 8, 9 and the bearings 7 cannot be removed from the housing 2, when replacing the rolls, because of the structure of the rolling mill. Thus, this type of rolling mill requires that roll replacement be performed by a method as illustrated in FIG. 12. In FIG. 12, $M_1$ denotes a chockless rolling mill being used on a hot rolling line, $M_2$ and $M_3$ denote two spare chockless rolling mills of the same structure, Ds denotes a drive side of the rolling line, and Ws denotes a work side of the rolling line.

The rolls are replaced in the following manner: When the rolls 8, 9 of the rolling mill $M_1$, placed on the line, are surface-roughened, the entire rolling mill $M_1$ is pulled out to an $M_1'$ position indicated by a one-dot chain line at the work side of the rolling line. Immediately thereafter, the spare chockless rolling mill $M_2$ is assembled onto the rolling line. The removed rolling mill $M_1$ is laid horizontally so that the upper and lower rolls 8 and 9 will lie horizontally. The rolls 8, 9 are supported on a horizontal base, while the respective housings 2 on the drive side Ds and the work side Ws are suspended by cranes, detached horizontally from the rolls, and kept in that position temporarily.

The detached rolls 8, 9 on the base are polished with a polishing machine, and assembled to the housings 2 on the drive side Ds and the work side Ws in the same manner as described above. The assembly is placed on standby as a spare rolling mill $M_1$.

According to the foregoing conventional roll replacing method for a rolling mill, the heavy body of the rolling mill is handled in a suspended manner for roll removed and mounting. It takes a long time to removed the rolls from the body of the rolling mill, polish them, and mount them, thus completing repair. A single spare rolling mill $M_2$ is not enough, because replacement of the rolls cannot be completed before the next replacement of the rolling mill $M_2$ on the rolling line needs to be carried out. Thus, two or three spare rolling mills become necessary, thus the facility cost.

SUMMARY OF THE INVENTION

The object of the present invention is to provide a method and a system for replacement of rolls in a chockless rolling mill, the method and system being capable of roll replacement by use of upper and lower work rolls as a spare unit, and incurring a low facility cost.

According to a first aspect of the present invention for attaining the above object, there is provided a roll replacing method for a chockless rolling mill, in which bearings for supporting the ends of work rolls are supported at an eccentric position of rotary bushes provided on housings, and the rotary bushes are turned to set a roll gap. The roll replacing method comprises:

moving the chockless rolling mill from a rolling line onto a pullout track extending in a direction perpendicular to the rolling line;

fixing a housing on a drive side onto the pullout track at a predetermined position, moving a support trestle in a direction perpendicular to the pullout track, and fitting the support trestle between the pullout track and an upper work roll and a lower work rolls to support the upper and lower work roll on the support trestle;

separating a housing on a work side and the support trestle, supporting the upper and lower work rolls, separating the housing on a work side from the support trestle, and moving the housing on a work side, the support trestle, supporting the work rolls, onto the pullout track until they come to a halt; and moving the support trestle and the upper and lower work rolls, as a unit, onto a roll replacement track, provided in a direction perpendicular to the pullout track, to replace at least one of the upper and lower work rolls, as a unit, by spare upper and lower work rolls, as a unit, and the support trestle and the upper and lower work rolls, as a unit, by a spare support trestle and spare upper and lower work rolls, as a unit.

According to a second aspect of the invention, there is provided a roll replacing system for a chockless rolling mill on a rolling line, comprising:

a rolling mill pullout track laid on a work side of the chockless rolling mill in a direction perpendicular to the rolling line;

a pullout drive unit which moves the chockless rolling mill along the pullout track;

a roll replacement track laid to intersect the pullout track in a direction perpendicular thereto a replacing drive unit which provides replacement rolls along the roll replacement track;

a first detachable fixing unit which stops a drive-side housing, the first detachable fixing unit being disposed spaced from the roll replacement track in a direction toward the rolling line;

a trestle yard unit which movably supports a support trestle, which can be attached to and detached from upper and lower work rolls, and which can support and move the upper and lower work rolls, the trestle yard unit being spaced from the roll replacement track at least by a first roll end pullout distance in the direction toward the rolling line, and the trestle yard unit being disposed away from the rolling line with respect to the first detachable fixing unit; and a second detachable fixing unit which stops a work-side housing, the second detachable fixing unit being disposed spaced from the roll replacement track at least by a second roll end pullout distance in a direction of a side opposite to the rolling line with respect to the trestle yard unit.

PREFERRED EMBODIMENTS OF THE INVENTION

A roll replacing method and a roll replacing system for a chockless rolling mill according to a preferred embodiment of the present invention will now be described in detail by way of an Example with reference to the accompanying drawings.

[Example]

Figure 1:
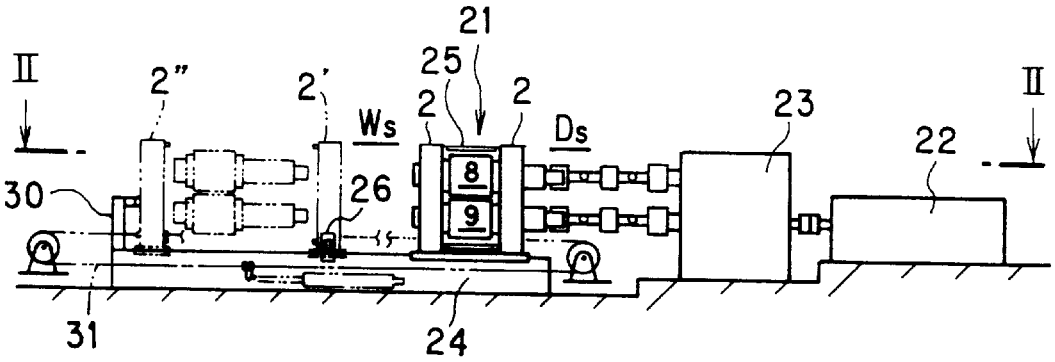
FIG. 1 is a side view showing an entire roll replacing system for a chockless rolling mill according to an embodiment of the present invention during a roll replacing process.
Figure 2:
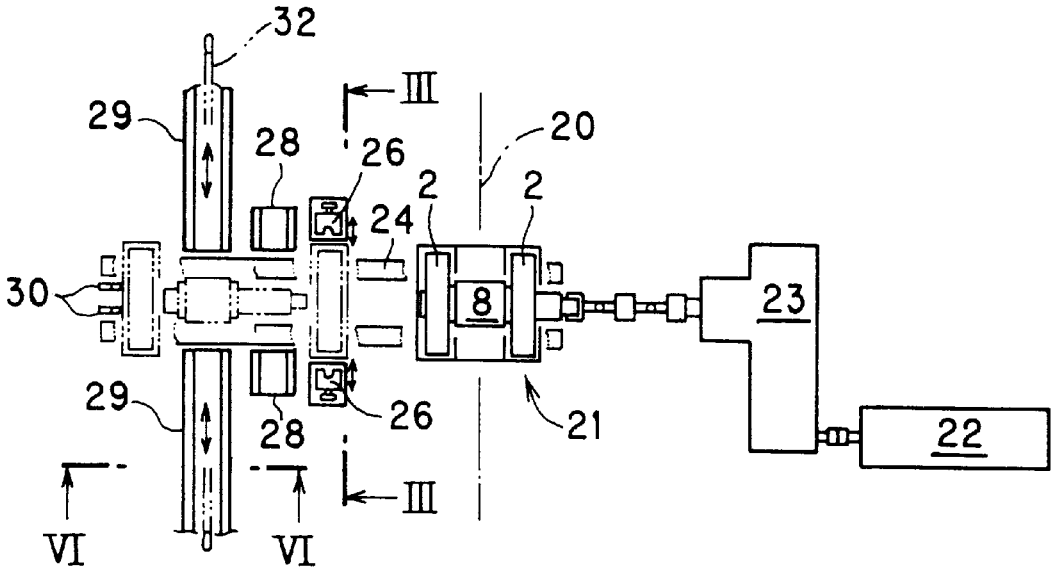
FIG. 2 is a plan view taken along line II—II of FIG. 1.

In FIGS. 1 and 2, the reference numeral 21 denotes a chockless rolling mill provided on a hot rolling line 20. The chockless rolling mill 21 has upper and lower work rolls 8 and 9 whose ends on a drive side Ds are connected to an output shaft of a speed reducer 23 joined to a drive motor 22. The chockless rolling mill 21 is supported on an end of a rolling mill pullout track 24, laid toward a work side Ws, provided in a direction perpendicular to the hot rolling line 20.

Figure 10:
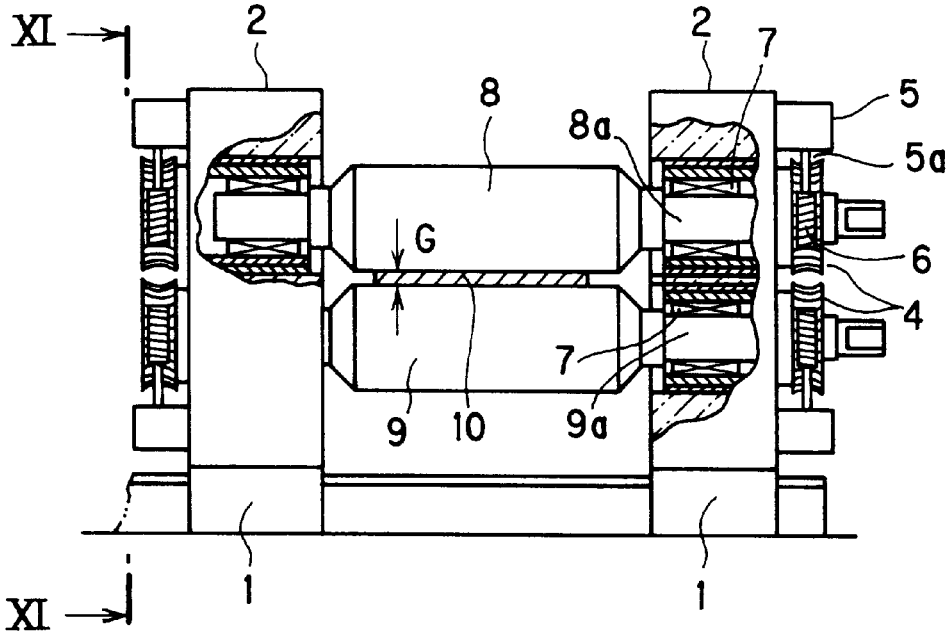
FIG. 10 is a front view showing an outline of an ordinary chockless rolling mill.
Figure 11:
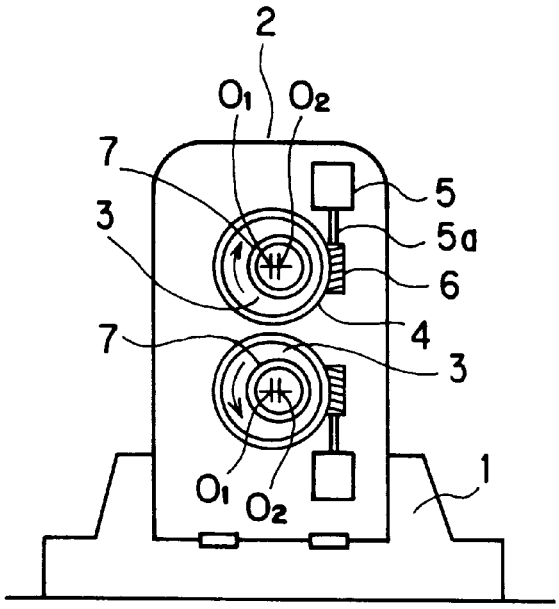
FIG. 11 is a side view taken along line XI—XI of FIG. 10.
Figure 12:
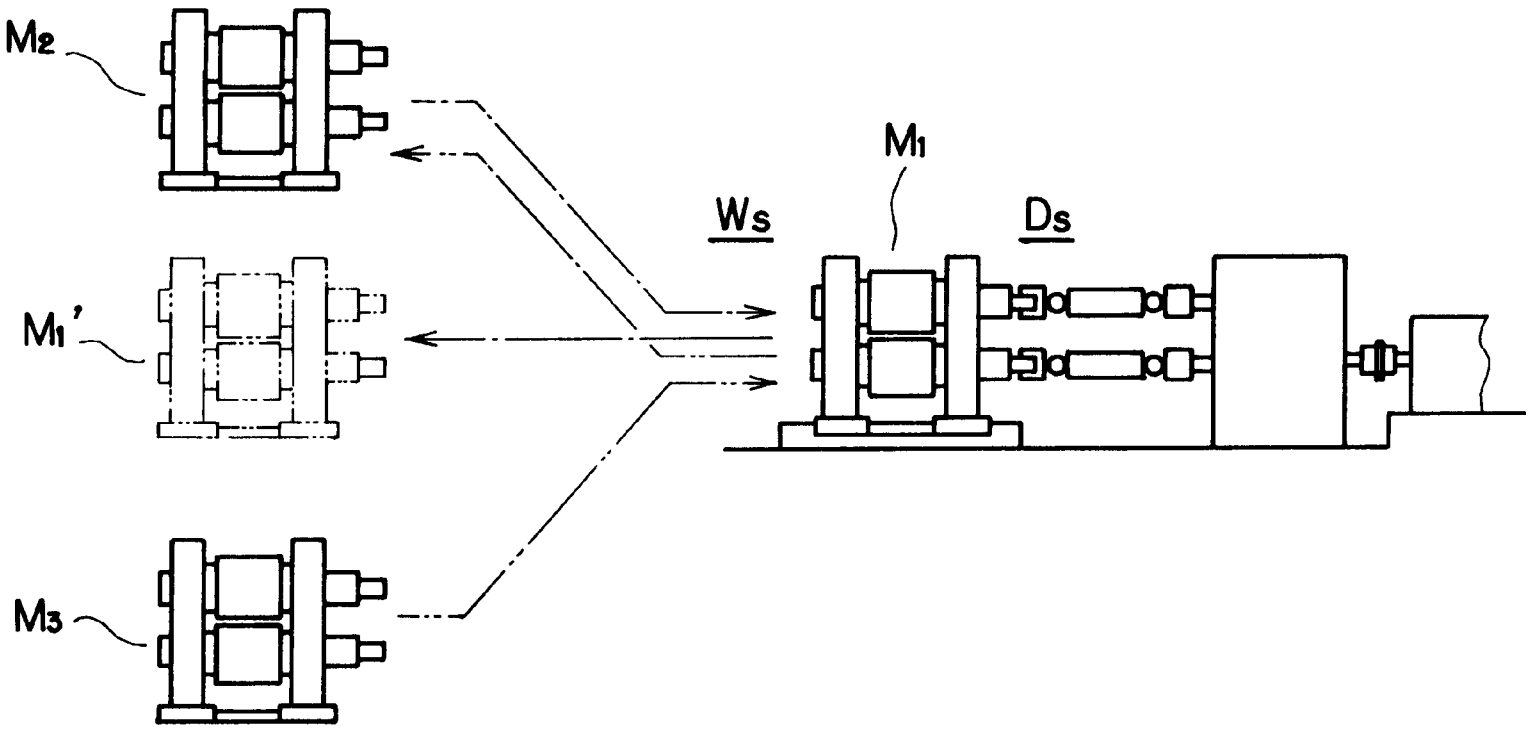
Fig.12 Related Art
FIG. 12 is an explanatory drawing of a conventional roll replacing method.

A pair of housings 2 of the chockless rolling mill 21 are connected together by a plurality of parallel detachable beams 25 extending along the direction in which the housings 2 are opposed to each other. When the detachable beams 25 are released, the pair of housings 2 become individually movable on the rolling mill pullout track 24. The remaining constitution of the chockless rolling mill 21 is the same as that illustrated in FIGS. 10 and 11, by reference to which a detailed explanation therefor will be omitted herein.

On both sides of the rolling mill pullout track 24, fixing means 26 for a drive-side housing 2' are provided at a position nearest to the hot rolling line 20. Behind the fixing means 26, trestle yards 28 for a detachable roll support trestle 27, to be described later, are provided.

At a position spaced from the trestle yards 28 by a certain distance (a distance over which the end of the roll is withdrawn from a bearing 7), a roll replacement track 29 is provided in a direction perpendicular to the rolling mill pullout track 24. Further apart by a certain distance (a distance over which the end of the roll is withdrawn from the bearing 7), fixing means 30 for a work-side housing 2" are provided.

The reference numeral 31 denotes a pullout drive means, for moving the chockless rolling mill 21, provided along the rolling mill pullout track 24. The pullout drive means 31 can be composed of an endless drive chain or the like, and can selectively perform drawing-in movement of the entire chockless rolling mill 21, drawing-in movement of the work-side housing 2 of the chockless rolling mill 21, or drawing-in movement of the roll support trestle 27 supporting the rolls.

The reference numeral 32 is a drive means for roll replacement provided along the roll replacement track 29. This drive means 32 can also be composed of an endless drive chain or the like.

Figure 3:
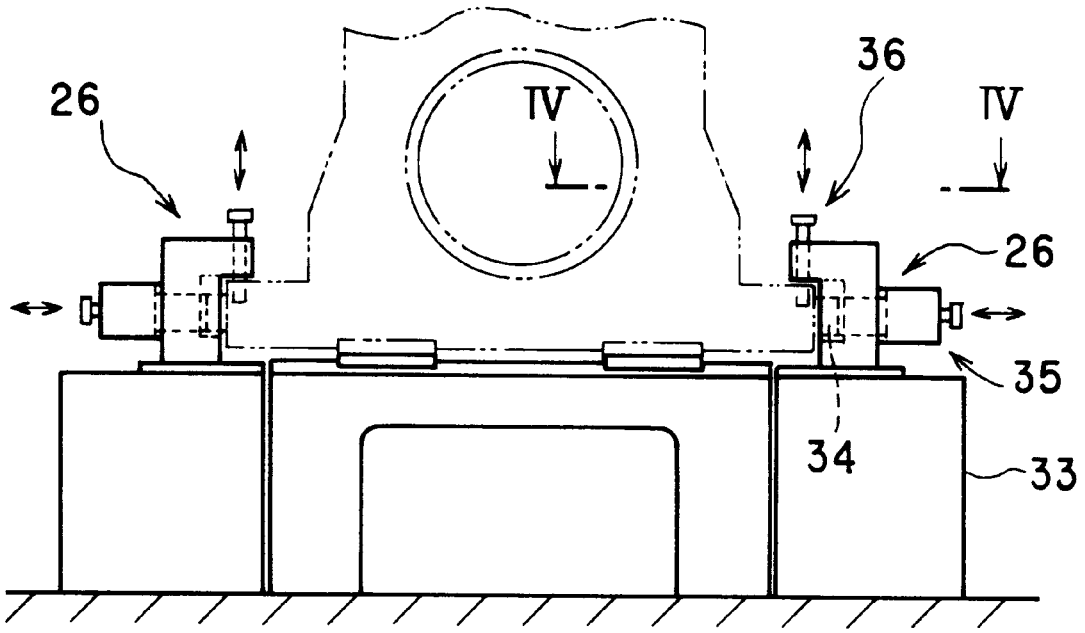
FIG. 3 is an enlarged front view taken along line III—III of FIG. 2.
Figure 4:
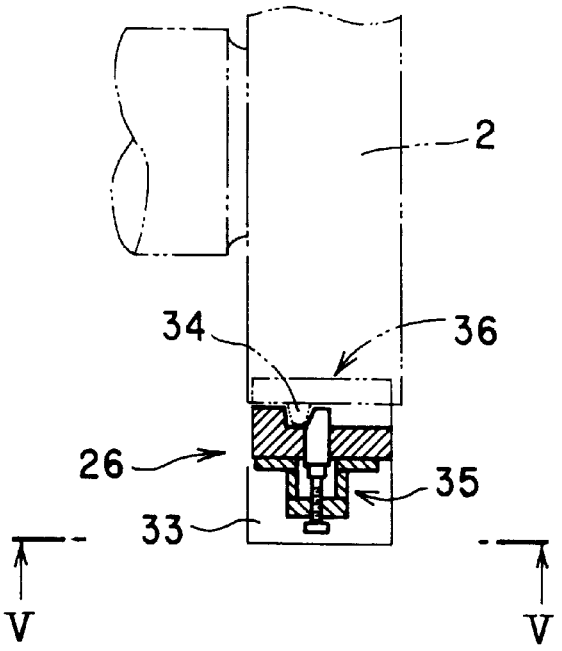
FIG. 4 is a plan view taken along line IV—IV of FIG. 3.
Figure 5:
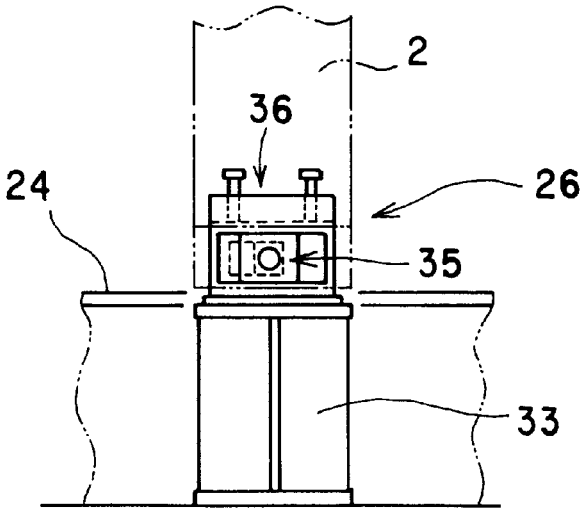
FIG. 5 is a side view taken along line V—V of FIG. 4.

In FIGS. 3 to 5, the fixing means 26 for the drive-side housing 2 are mounted fixedly on trestles 33 placed in contact with side portions of the rolling mill pullout track 24. The fixing means 26 has a slide block mechanism 35, which detachably grips and restrains a vertical projection 34 formed in a lower flange side portion of the drive-side housing 2, and a press anchor mechanism 36, which detachably presses down the upper surface of the lower flange of the drive-side housing 2.

Figure 6:
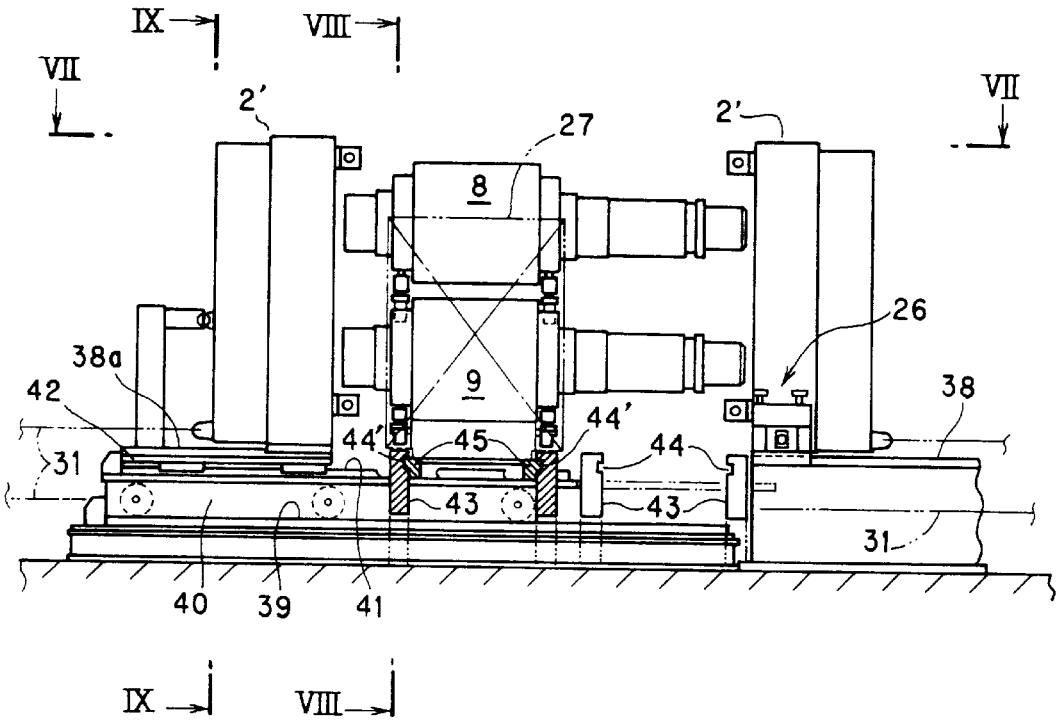
FIG. 6 is a side view of an example taken along line VI—VI of FIG. 2.
Figure 7:
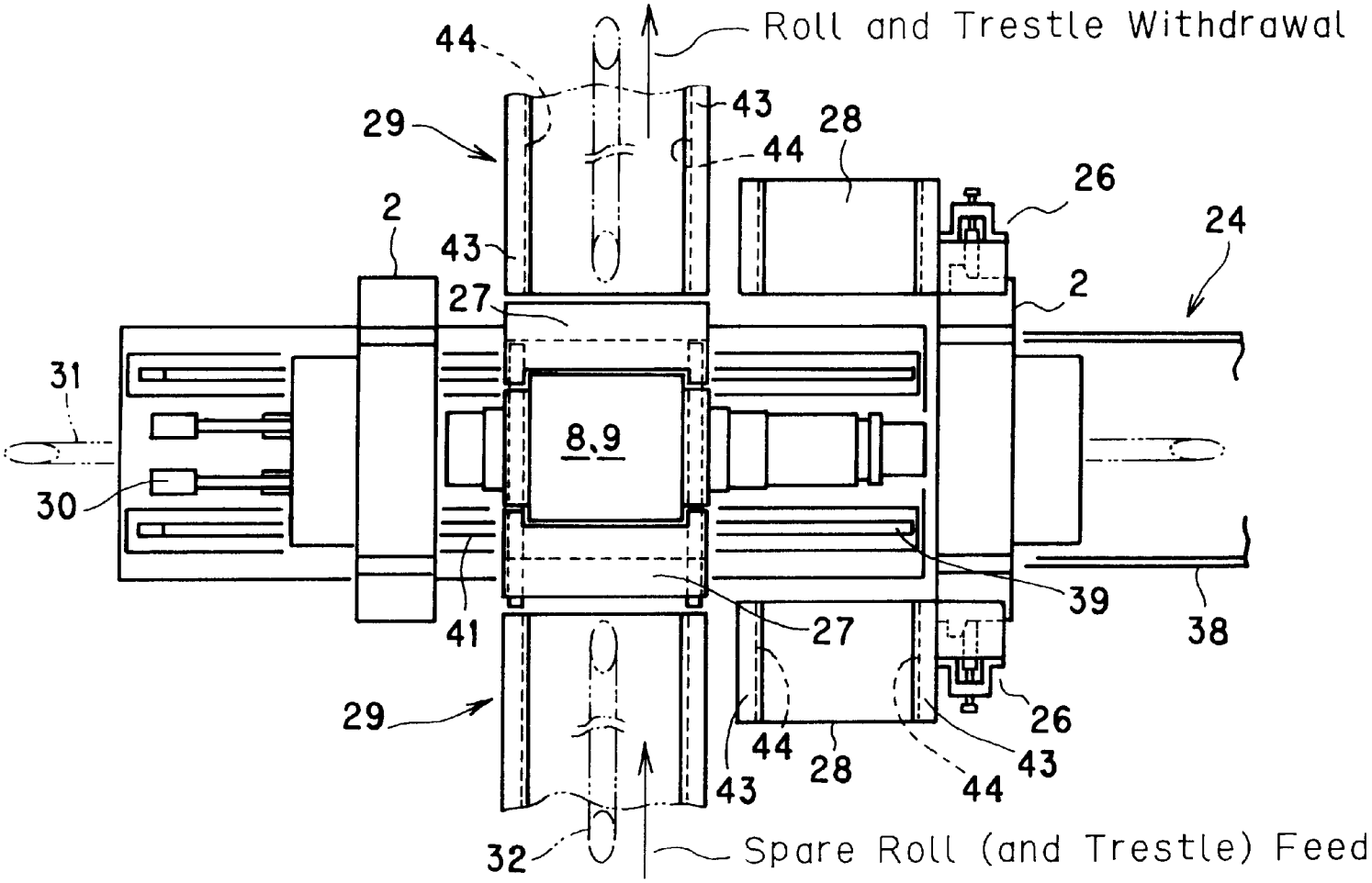
FIG. 7 is a plan view taken along line VII—VII of FIG. 6.

In FIGS. 6 and 7, the rolling mill pullout track 24 includes a fixed track 38, having a certain height, in a range from the hot rolling line 20 to the position of mounting of the drive-side housing fixing means 26. Adjacent the end of the fixed track 38, a trolley track 39, less tall than the fixed track 38, is provided on a base. On the trolley track 39, a self-propelled moving trolley 40 is placed. On a separate track 41, laid on the moving trolley 40, a moving base 42 is slidably supported. On this moving base 42, a connecting track 38*a*, aligning with the fixed track 38, is provided.

The trestle yards 28 are located at positions at which the drive-side housing 2' is fixed by the fixing means 26, and at which frames of the roll support trestle 27 can be attached to or detached from the upper and lower work rolls 8 and 9, supported by the drive-side and work-side housings 2', 2", from both sides of the rolling mill pullout track 24 in opposing directions.

The trestle yard 28 has a pair of horizontal support members 43 extending in a direction intersecting the rolling mill pullout direction, and has symmetrical horizontal grooved tracks 44 at opposed surfaces of the horizontal support members 43. Horizontal projections 45 at a lower portion of the roll support trestle 27 are slidably accepted and supported by the grooved tracks 44. The roll support trestle 27 makes an incoming and an outgoing motion between a standby position on the yard 28 and a site on the moving trolley 40 under the action of detachable drive means 53 to be described later.

On the hot rolling line side of the moving trolley 40, grooved tracks 44', corresponding to the grooved tracks 44 of the trestle yard 28, are fixedly mounted via horizontal support members 43 so as to intersect the track 41 on the trolley 40. On the opposite end side on the moving trolley 40, work-side housing fixing means 30, in the form of a post are provided to detachably fix and support the work-side housing 2" pulled out onto the moving base 42.

The roll replacement track 29 is positioned adjacent the trestle yards 28 so that the ends of the work rolls 8 and 9 can be kept apart from the drive-side housing 2. Like the trestle yard 28, the roll replacement track 29 has horizontal support members 43 and horizontal grooved tracks 44, and is disposed in a direction intersecting the rolling mill pullout track 24. The roll replacement track 29 communicates with spare work roll yards (not shown).

A roll replacement drive means 32 detachably connects with the roll support trestle 27 on the trolley 40 that has moved to the intersection of the roll replacement track 29 and the rolling mill pullout track 24. Then, the roll replacement drive means 32 moves the roll support trestle 27 between a site on the moving trolley 40 and the spare work roll yard.

Figure 8:
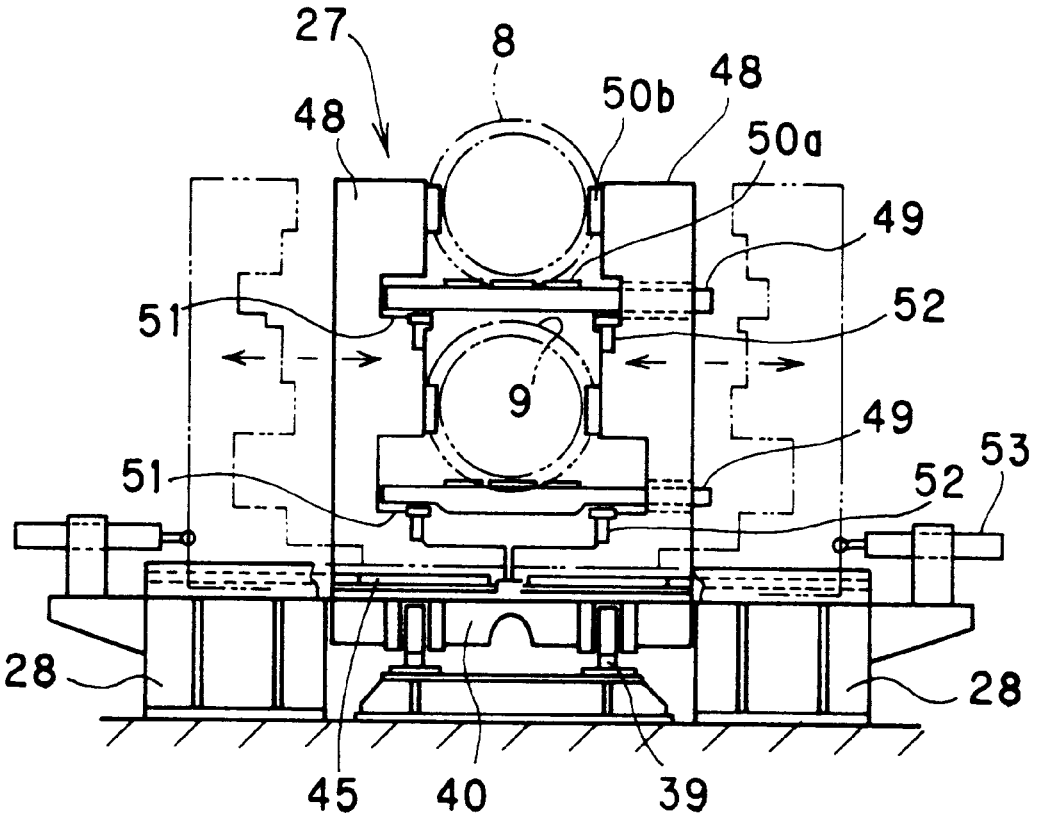
FIG. 8 is a front view taken along line VIII—VIII of FIG. 6.
Figure 9:
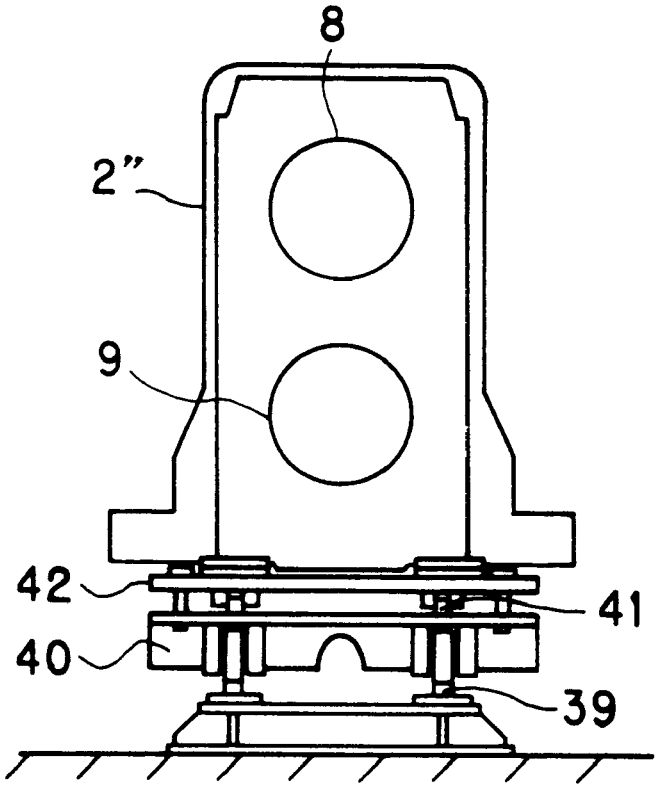
FIG. 9 is a front view taken along line IX—IX of FIG. 6.

In FIGS. 8 and 9, the roll support trestle 27 is composed of nearly symmetrical roll trestle frames 48 spaced by a width across a roll neck in the axial direction of the work roll 8 or 9, and two (upper and lower) roll support beams 49 inserted below the roll neck of each of the upper and lower work rolls 8 and 9 to span the distance between both roll trestle frames 48. The reference numeral 50*a* denotes a roll support liner on an upper surface of the roll support beam 49.

Each frame 48, has, at a lower portion thereof projections 45 extending in a direction perpendicular to the work roll. These projections 45 are slidingly engaged with the horizontal grooved tracks 44 of the yard 28, the horizontal grooved tracks 44' on the moving trolley 40, and the horizontal grooved tracks 44 of the roll replacement track 29, to permit movement between the adjacent grooved tracks.

The pair of roll trestle frames 48 are provided with liners 50*b* to be pressed against the roll neck side surfaces of the work rolls 8 and 9, hole or support surfaces 51 for supporting the two (upper and lower) roll support beams 49, and beam push-up jacks 52 provided make contact with the lower surfaces of both ends of the roll support beams 49.

The detachable drive means 53 are provided at outer ends of the trestle yards 28, and have the front end of an expansion drive portion thereof attached to or detached from the roll trestle frame 48 to move the roll support trestle 27 between the standby position on the trestle yard 28 and a site on the moving trolley 40 where the roll trestle frame 48 is fitted to the work roll 8 or 9.

The two (upper and lower) roll support beams 49 are supported in one roll trestle frame 48, and moved together with this roll trestle frame 48. The roll support beams 49 can also be delivered by a moving means or the like (not shown) on the roll trestle frame 48 to a position at which they span the space between the holes or roll support surfaces 51 in the pair of roll trestle frames 48.

In moving the entire chockless rolling mill 21, the work-side housing 2", or the roll support trestle 27, the pullout drive means 31 attaches to or separates from the object to be moved, and moves any of them over a predetermined distance.

As the pullout drive means 31 or the roll replacement drive means 32, other type of drive system may be used. The pullout drive means 31 may be provided separately as a drive system for each of the movement of the entire rolling mill, the movement of the housing, and the movement of the roll trestle.

The overall constitution of the rolling mill pullout track 24 and the roll replacement track 29, as well as the constitutions of the respective track systems 38, 38*a*, 39 and 44, the housing fixing means 26 and 30, and the roll support trestle 27 are not limited to the exemplified structures, but their designs may be freely changed or modified.

Because of these constitutions, the self-propelled moving trolley 40, and the moving base 42 and the connecting track 38*a* on the moving trolley 40 stop at a position of their contact with the fixed track 38 on the hot rolling line 20 side during normal operation of the hot rolling line, as shown in FIGS. 1 and 6. At this location, they bring the roll support trestle 27 to a halt on the trestle yard 28, and enter the wait state.

According to this embodiment, the roll replacement of the chockless rolling mill 21 is performed by the above-described system in accordance with the method stated below.

(1) At first, when the necessity for roll replacement of the chockless rolling mill 21 arises, a rolling operation is stopped, and the chockless rolling mill 21 is pulled out from a site on the hot rolling line 20 onto the work-side rolling mill pullout track 24 by the pullout drive means 31.

(2) The pullout movement of the chockless rolling mill 21 is stopped at a position at which the body of the chockless rolling mill 21 rides on the connecting track 38*a* on the moving trolley 40, while only the drive-side housing 2' fits to the fixing means 26. The drive-side housing 2' is restrained and fixed by the fixing means 26. In this state, the grooved tracks 44' on the moving trolley 40 are aligned with the grooved tracks 44 of the trestle yard 28. The pullout drive means 31 is detached from the chockless rolling mill 21, and the detachable beams 25 between the housings 2' and 2" are removed.

(3) The frames 48 of the roll support trestle 27 on the trestle yards 28 on both sides are delivered onto the moving trolley 40 by the detachable drive means 53. The roll support trestle 27 is fitted to the gaps of the upper and lower work rolls 8 and 9, and the necks of the upper and lower work rolls 8 and 9 are restrained by the liners 50*b* on the roll support trestle 27 from both sides. At the same time, the roll support beams 49 on one of the frames 48 of the roll support trestle 27 are delivered to a position at which the roll support beams 49 span the space between the roll support surfaces 51 of the roll trestle frames 48.

The beam push-up jacks 52 in the roll support trestle 27 are extended to push up the roll support beams 49 with a slightly larger push-up force than the weight of each work roll 8 or 9. Thus, the lower surface of the neck of each of the work rolls 8 and 9 is supported by the surface of the liner 50*a* on the roll support beam 49. In this state, the weight of the work roll 8 or 9 is not imposed on the bearing 7 of the drive-side or work-side housing (see FIG. 10). Hence, the roll support trestle 27 and the work-side housing 2" become movable independently of each other.

(4) After the detachable drive means 53 are separated from the roll support trestle 27, the moving trolley 40 is moved in a self-propelled manner away from the hot rolling line 20. The moving trolley 40 is brought to a halt at a position at which the grooved tracks 44' supporting the roll support trestle 27 on the moving trolley 40 align with the grooved tracks 44 of the roll replacement track 29. As a result of this procedure, the work-side housing 2" and the roll support trestle 27 move together, and the drive-side ends of the work rolls 8, 9 on the roll support trestle 27 are withdrawn from the bearings 7 of the drive-side housing 2'.

(5) The pullout drive means 31 is connected to the work-side housing 2" to move the work-side housing 2" slidingly over a certain distance away from the hot rolling line 20 along the connecting track 38*a* on the stopped moving trolley 40. The work-side housing 2" is stopped at a position at which it can be connected to the post-shaped fixing means 30. Then, this work-side housing 2" is connected to the work-side post-shaped fixing means 30. During this procedure, the work-side housing 2" (bearing 7) is extracted from the ends of the work rolls 8, 9 on the roll support trestle 27, while the roll support trestle 27 is left alone on the roll replacement track 29.

(6) One of the roll replacement drive means 32, communicating with the spare roll yard, is connected to the roll support trestle 27, so that the roll support trestle 27 is moved to the spare roll yard by the roll replacement drive means 32.

The pair of worn upper and lower work rolls 8 and 9, on the roll support trestle 27, are lowered onto an empty shelf of the roll yard. A pair of upper and lower spare work rolls 8 and 9 that have been polished are transferred from the shelf onto the roll support trestle 27. The roll support trestle 27 is returned from the spare roll yard onto the moving trolley 40 that has been at a standstill on the rolling mill pullout track 24. Then, the roll replacement drive means 32 is detached from the roll support trestle 27. This method is adopted when replacing the upper and lower work rolls 8 and 9, as a unit, of the chockless rolling mill 21. Instead of this method, it is possible to perform a method in which spare work rolls 8 and 9 and roll support trestle 27 for replacement are used, as a unit, as spare products for replacement. In this case, the work rolls 8, 9 and roll support trestle 27, which have been withdrawn from the hot rolling line 20 onto the moving trolley 40 stopped on the line of the roll replacement track 29, are delivered to one side of the roll replacement track 29. Immediately thereafter, the spare work rolls 8 and 9 and roll support trestle 27, as a unit, are fed onto the moving trolley 40 from the other side of the roll replacement track 29, whereby roll replacement can be performed promptly.

(7) The pullout drive means 31 is connected to the work-side housing 2" to move the work-side housing 2" slidingly toward the roll support trestle 27. On the roll support trestle 27, at this time, the weight of the work rolls 8, 9 is supported on the roll support beams 49 by the push-up force of the beam push-up jacks 52 having a slightly larger push-up force than that weight. Thus, when the ends of the work rolls 8, 9 contact the bearings 7 of the housing 2", the floating roll ends are lightly pushed down upon contact with the bearings 7, and fitted into the bearings 7 smoothly and easily.

(8) The pullout drive means 31 is detached from the work-side housing 2", and the moving trolley 40 is moved in a self-propelled manner to a position at which it makes contact with the drive-side housing 2'. At this time, too, the work rolls 8, 9 are floatingly supported by the push-up force of the beam push-up jacks 52 having a slightly larger push-up force than the weight of the work rolls 8, 9. Thus, the ends of the work rolls 8, 9 and the bearings 7 of the housing 2' can be fitted together smoothly.

(9) The beam push-up jacks 52 are driven contractedly, and then the detachable drive means 53 of the trestle yards 28 are connected to the roll trestle frames 48. The roll trestle frames 48 and the roll support beams 49 are retracted onto the trestle yards 28, whereafter the detachable beams 25 are connected between both housings 2' and 2".

(10) The drive-side housing fixing means 26 for the drive-side housing 21 are released, and the entire chockless rolling mill 21 is slidingly moved onto the fixed track 38 by the pullout drive means 31. Consequently, the chockless rolling mill 21 is set in place on the hot rolling line 20 to complete roll replacement.

According to the first aspect of the invention, there is provided a roll replacing method for a chockless rolling mill, in which bearings for supporting the ends of work rolls are supported at an eccentric position of rotary bushes provided on housings, and the rotary bushes are turned to set a roll gap, comprising:

moving the chockless rolling mill from a rolling line onto a pullout track extending in a direction perpendicular to the rolling line;

fixing a housing on a drive side onto the pullout track at a predetermined position, moving a support trestle in a direction perpendicular to the pullout track, and fitting the support trestle between the pullout track and an upper work roll and a lower work rolls to support the upper and lower work roll on the support trestle;

separating, from the housing on a drive side, a housing on a work side and the support trestle, supporting the upper and lower work rolls, separating the housing on a work side from the support trestle, and moving the housing on a work side, the support trestle, and supporting the work rolls, onto the pullout track until they come to a halt; and moving the support trestle and the upper and lower work rolls, as a unit, onto a roll replacement track provided in a direction perpendicular to the pullout track, to replace at least one of the upper and lower work rolls, as a unit, by spare upper and lower work rolls, as a unit, and the support trestle and the upper and lower work rolls, as a unit, by a spare support trestle and spare upper and lower work rolls, as a unit. Thus, the whole process, including removal/mounting of the rolling mill, fixing/release of the drive-side housing, attachment/detachment of the roll support trestle, extraction/fitting of the rolls from and into the housing, and exchange of the roll support trestle, can be handled mechanically during roll replacement for the chockless rolling mill. Hence, the individual steps and all the steps can be easily automated. Furthermore, there is no need to replace the entire chockless rolling mill as a unit to be replaced. It suffices to use either only the upper and lower work rolls, or the upper and lower work rolls and the roll support trestle, as a unit, to be replaced, thus making it possible to replace the rolls speedily.

According to the second aspect of the invention, there is provided a roll replacing system for a chockless rolling mill on a rolling line, comprising:

a rolling mill pullout track laid on a work side of the chockless rolling mill in a direction perpendicular to the rolling line;

a pullout drive unit which moves the chockless rolling mill along the pullout track;

a roll replacement track laid to intersect the pullout track in a direction perpendicular thereto a replacing drive unit which provides replacement rolls along the roll replacement track;

a first detachable fixing unit which stops a drive-side housing, the first detachable fixing unit being disposed spaced from the roll replacement track in a direction toward the rolling line;

a trestle yard unit which movably supports a support trestle, which can be attached to and detached from upper and lower work rolls, and which can support and move the upper and lower work rolls, the trestle yard unit being spaced from the roll replacement track at least by a first roll end pullout distance in the direction toward the rolling line, and the trestle yard unit being disposed away from the rolling line with respect to the first detachable fixing unit; and a second detachable fixing unit which stops a work-side housing, the second detachable fixing unit being disposed spaced from the roll replacement track at least by a second roll end pullout distance in a direction of a side opposite to the rolling line with respect to the trestle yard unit.

Thus, the roll replacing system obtains the same actions and effects as the first aspect of the invention.

While a preferred embodiment of the present invention has been described, it is to be understood that such description is for illustrative purposes only, and various changes and modifications may be made without departing from the spirit and scope of the invention.

What is claimed is:

1. A roll replacing method for a chockless rolling mill, in which bearings for supporting the ends of work rolls are supported at an eccentric position of rotary bushes provided on housings, and the rotary bushes are turned to set a roll gap, comprising:

moving the chockless rolling mill from a rolling line onto a pullout track extending in a direction perpendicular to the rolling line;

fixing a housing on a drive side onto the pullout track at a predetermined position, moving a support trestle in a direction perpendicular to the pullout track, and fitting the support trestle between the pullout track and an upper work roll and a lower work roll to support the upper and lower work rolls on the support trestle;

separating, from the housing in a drive side, a housing on a work side and the support trestle, supporting the upper and lower work rolls, separating the housing on a work side from the support trestle, and moving the housing on a work side and the support trestle, supporting the work rolls onto the pullout track until they come to a halt; and moving the support trestle and the upper and lower work rolls, as a unit, onto a roll replacement track, which is provided in a direction perpendicular to the pullout track, to replace at least one of the upper and lower work rolls, as a unit, by spare upper and lower work rolls, as a unit, and the support trestle and the upper and lower work rolls, as a unit, by a spare support trestle and spare upper and lower work rolls, as a unit.

2. A roll replacing system for a chockless rolling mill on a rolling line, comprising:

a rolling mill pullout track laid on a work side of the chockless rolling mill in a direction perpendicular to the rolling line;

a pullout drive unit which moves the chockless rolling mill along the pullout track;

a roll replacement track laid to intersect the pullout track in a direction perpendicular thereto;

replacing drive unit which provides replacement rolls along the roll replacement track;

first detachable fixing unit which stops a drive-side housing, said first detachable fixing unit being disposed spaced from the roll replacement track in a direction toward the rolling line;

trestle yard unit which movably supports a support trestle, which is selectively attached to and detached from upper and lower work rolls, and which supports and moves the upper and lower work rolls, said trestle yard unit being spaced from the roll replacement track at least by a first roll end pullout distance in the direction toward the rolling line, and said trestle yard unit being disposed away from the rolling line with respect to the first detachable fixing unit; and second detachable fixing unit which stops a work-side housing, said second detachable fixing unit being disposed spaced from the roll replacement track at least by a second roll end pullout distance in a direction of a side opposite to the rolling line with respect to the trestle yard unit.

* * * * *